US006045216A

United States Patent [19]

Sasaki

[11] Patent Number: 6,045,216

[45] Date of Patent: Apr. 4, 2000

[54] INK JET PRINT HEAD AND INK JET PRINTER WITH COVER BODY ENCASING AND ALIGNING HEAD CHIPS

[75] Inventor: Toyonori Sasaki, Anjo, Japan

[73] Assignee: Brother kogyo Kabushiki Kaisha, Nagoya, Japan

[21] Appl. No.: 08/701,746

[22] Filed: Aug. 22, 1996

[30] Foreign Application Priority Data

Aug. 30, 1995 [JP] Japan ..... 7-246869

[51] Int. Cl.[7] ..... B41J 2/14

[52] U.S. Cl. ..... 347/49

[58] Field of Search ..... 347/49, 85, 86, 347/87, 67

[56] References Cited

U.S. PATENT DOCUMENTS 5,408,746 4/1995 Thoman et al. ..... 347/49
5,450,110 9/1995 Sato et al. ..... 347/67
5,604,523 2/1997 Tsukuda et al. ..... 347/86

FOREIGN PATENT DOCUMENTS 402238947 9/1990 Japan ..... 347/49
6-316066 11/1994 Japan .

*Primary Examiner*—N. Le
*Assistant Examiner*—Hai C. Pham
*Attorney, Agent, or Firm*—Oliff & Berridge, PLC

[57] ABSTRACT

A print head including: a holder having a front surface; at least one head chip protruding from the front surface of the holder, the at least one head chip each having a nozzle surface formed with nozzles for ejecting ink; and a cover body covering the front surface of the holder and the at least one head chip and having at least one exposure opening for exposing the nozzle surface.

20 Claims, 5 Drawing Sheets

INK JET PRINT HEAD AND INK JET PRINTER WITH COVER BODY ENCASING AND ALIGNING HEAD CHIPS

BACKGROUND OF THE INVENTION

1. Field of the Invention

The present invention relates to an ink jet print head and to an ink jet printer for printing desired characters and symbols on a print sheet by ejecting ink from nozzles.

2. Description of the Related Art

In recent years, ink jet printers have been drawing attention because of their high speed, high print quality, and comparatively simple configuration. A typical ink jet printer is provided with an ink jet head formed with nozzles and actuators such piezoelectric ceramic elements. Piezoelectric deformation of the actuators operates in a manner of a pump to eject ink droplets from the nozzles. Ink jet heads for printing in full color can be formed from a plurality of head chips, each chip ejecting a particular color ink. In order to produce high quality color printing, the precision at which ink droplets are impinged onto a recording sheet must be the same for all the head chips.

Japanese Patent Application (Kokai) HEI-6-316066 discloses using a frame-shaped holder in order to fix orientation of a plurality of head chips in the vertical, horizontal, and height directions.

SUMMARY OF THE INVENTION

However, when producing components for the head with the above-described configuration, a certain amount of dimensional error in components is inevitable. Dimensional errors result in spaces forming between the head chips and the holder and between adjacent head chips. There is a potential problem in that ink droplets from the nozzles can seep through these gaps into the head. Ink that seeps into the head can short circuit contacts of a circuit board mounted within the head, which can result in the print head breaking down.

It is an objective of the present invention to overcome the above-described problems and to provide an easily manufactured ink jet head and an ink jet printer wherein a plurality of head chips can be aligned with high precision so that high quality color printing is possible and wherein any gaps between the head chips and the holder can be easily sealed so that ink drops can be prevented from seeping into the head itself, thereby protecting contact portions within the head.

In order to achieve the above-described objectives, a print head according to the present invention includes: a holder having a front surface; at least one head chip protruding from the front surface of the holder, the at least one head chip each having a nozzle surface formed with nozzles for ejecting ink; and a cover body covering the front surface of the holder and the at least one head chip and having at least one exposure opening for exposing the nozzle surface.

A printer according to the present invention includes: a holder having a front surface; a plurality of head chips juxtaposed in a line on and protruding from the front surface of the holder, each of the plurality of head chips having a nozzle surface formed with nozzles for ejecting ink; a cover body covering the front surface of the holder and the plurality of head chips, the cover body having a rear edge maintained in a sealed condition with the holder and a front edge maintained in a sealed condition with the plurality of head chips, the front edge bordering exposure openings exposing the nozzle surface of corresponding ones of the plurality of head chips; a carriage mounting the holder; and a carriage drive system for reciprocally and linearly moving the carriage.

BRIEF DESCRIPTION OF THE DRAWINGS

The above and other objects, features and advantages of the invention will become more apparent from reading the following description of the preferred embodiment taken in connection with the accompanying drawings in which.

DETAILED DESCRIPTION OF THE PREFERRED EMBODIMENT

Figure 1:
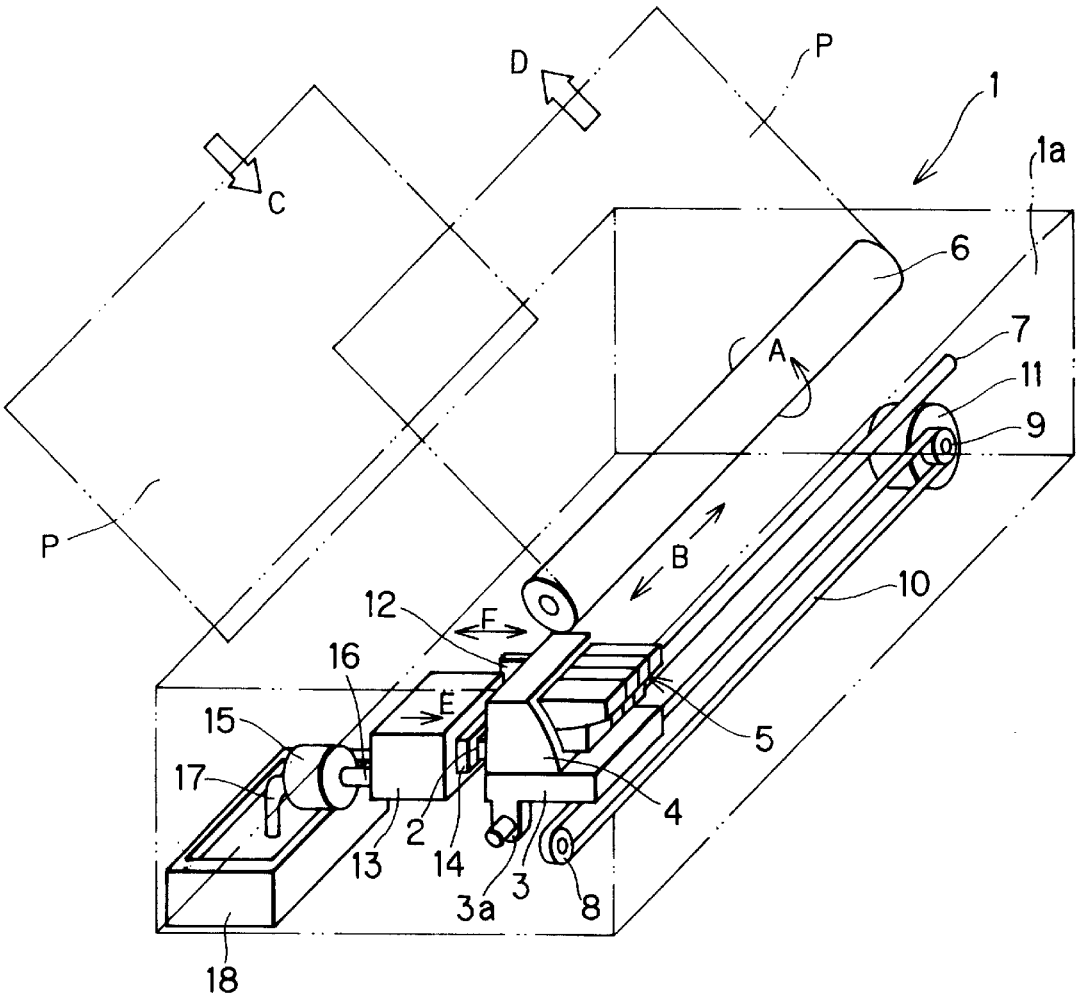
FIG. 1 is a perspective view schematically showing a color ink jet printer according to an embodiment of the present invention.

An ink jet print head and a printer using the print head according to a preferred embodiment of the present invention will be described while referring to the accompanying drawings wherein like parts and components are designated by the same reference numerals to avoid duplicating description.

FIG. 1 is a perspective view schematically showing a color ink jet printer according to the present embodiment. The color ink jet printer 1 includes an ink jet head 2 capable of ejecting four colors of ink (i.e., cyan, magenta, yellow, and black) onto a recording sheet such as a print sheet P; a head unit 4 provided integrally with the print head 2; an ink cartridge 5 provided on the head unit 4 for supplying four colors of ink to the print head 2; and a carriage 3 provided for supporting the print head 2 and for freely detachably mounting the head unit 4 and the ink cartridge 5.

The print head 2 is provided with piezoelectric ceramic elements which serve as energy generating elements for generating energy to eject droplets of ink. When a voltage is applied to the piezoelectric ceramic elements, they deform in a pumping action which is used to eject ink droplets for printing characters and symbols on the print sheet P. It should be noted that the print head 2 can be replaced with a thermal head which uses thermal-electric elements instead of piezoelectric elements.

A carriage shaft 7 is supported in a horizontal posture in a horizontal direction on a frame of a housing 1*a* of the ink jet printer 1. A carriage shaft support portion 3*a* provided to the underside of the carriage 3 is mounted on the carriage shaft 7 so that the carriage 3 is reciprocally and linearly movable in a direction indicated by an arrow B in FIG. 1. Pulleys 8 and 9 are provided at either end of the housing 1*a*. A belt 10 connected to the carriage 3 is suspended between the pulleys 8 and 9. When a motor 11 provided for driving the pulley 9 drives the pulley 9 to rotate, the carriage 3 is driven to move linearly and reciprocally along the carriage shaft 7. A freely rotatable platen roller 6 is provided in opposition to the front surface of the print head 2 in parallel with the carriage shaft 7. The print head 2 and the platen roller 6 form a print portion.

Although not shown in the drawings, a sheet supply cassette is provided to the upper-rear portion of the ink jet printer 1. The sheet supply cassette transports a print sheet P in a direction indicated by an arrow C in FIG. 1. The platen roller 6 is driven to rotate in a direction indicated by an arrow A so that the print sheet P is transported between the print head 2 and the platen roller 6. After printing is completed, the print sheet P is discharged in a direction indicated by an arrow D. As they do not deal directly with the invention, components for supplying and transporting the print sheet P have been omitted from the drawings.

During operation of the ink jet print head 2, bubbles are generated within the print head 2. Also ink droplets can cling to the surface of the nozzle plate of the print head 2. This can result in defective ejection of ink droplets. A head cleaning member 12 such as a wiper for cleaning the print head 2 is provided at the side of the platen roller 6. A purge unit 13 for preventing such defective ejections and for returning the print head 2 to the proper operating condition is provided at the side of the platen roller 6 in confrontation with the front side of a reset condition position of the print head 2. A cap 14 is provided to the tip of the purge unit 13. During purge operations, the purge unit 13 moves in the direction indicated by an arrow E so that the cap 14 is brought into abutment with the print head to cover the print head 2. A pump 15 generates a negative pressure within the cap 14 so that defective ink within the print head 2 is suctioned out of the nozzles and through pipes 16, 17. This cleans bubbles and other undesirable material from the nozzles and returns the print head 2 to proper operating condition. Suctioned defective ink is deposited in an accumulation tank 18.

Figure 2:
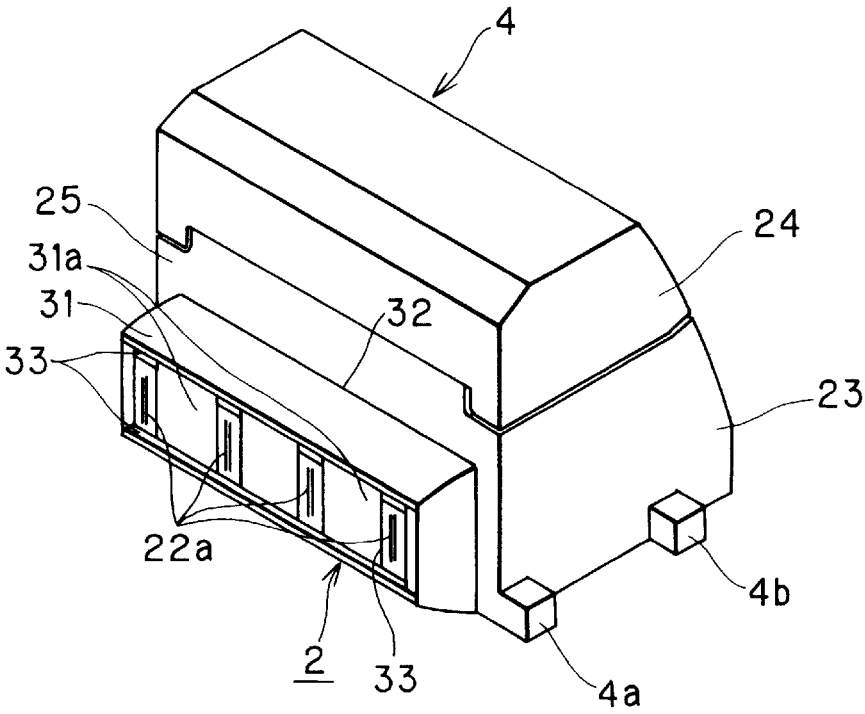
FIG. 2 is a perspective view of a head unit including a print head according to the embodiment.
Figure 3:
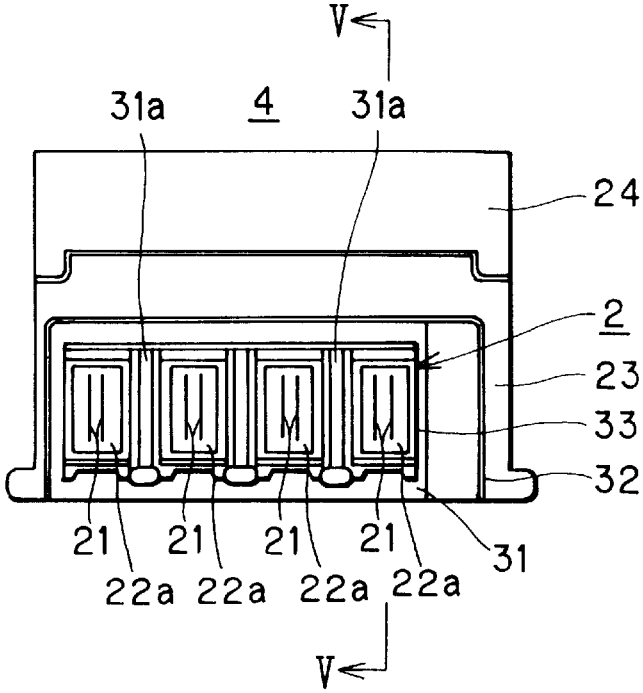
FIG. 3 is an exploded perspective view from the rear of the head unit with a portion removed to facilitate understanding of the configuration.
Figure 4:
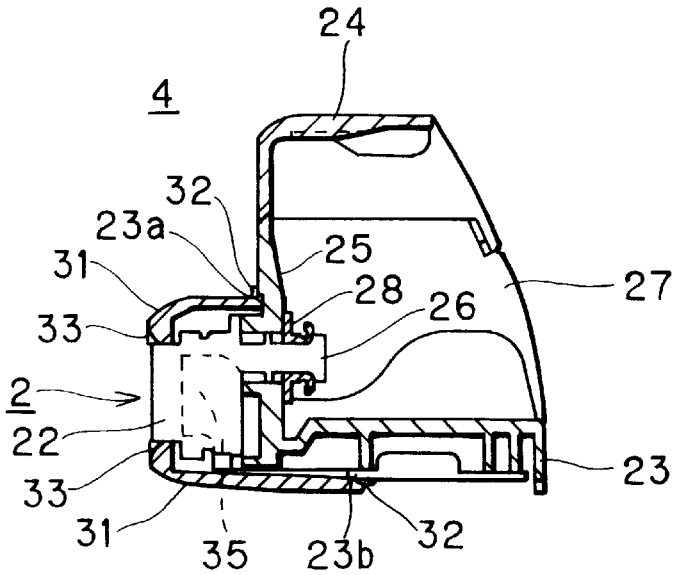
FIG. 4 is a plan view showing the print head.
Figure 5:
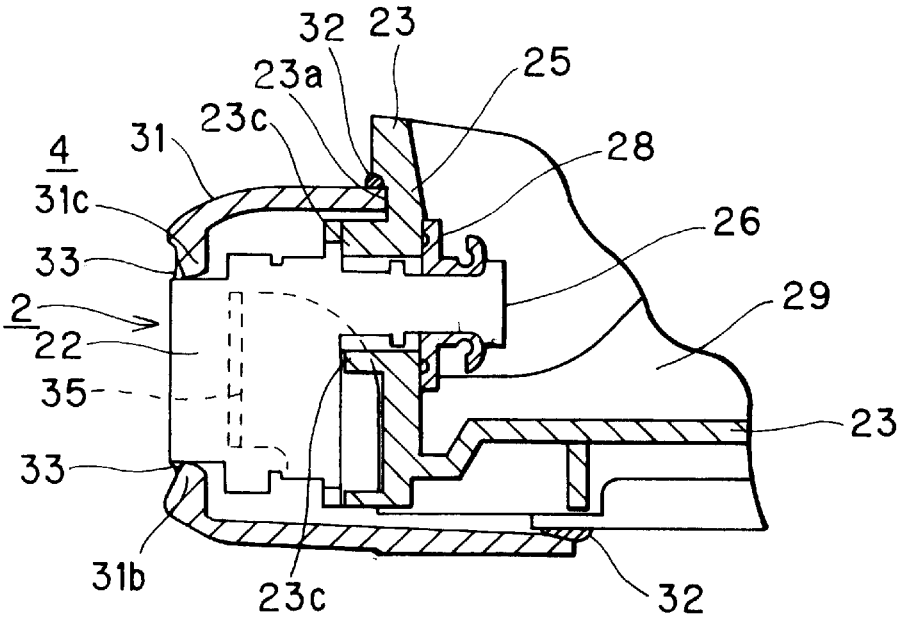
FIG. 5 is a cross-sectional view taken along line V—V of FIG. 4.
Figure 6:
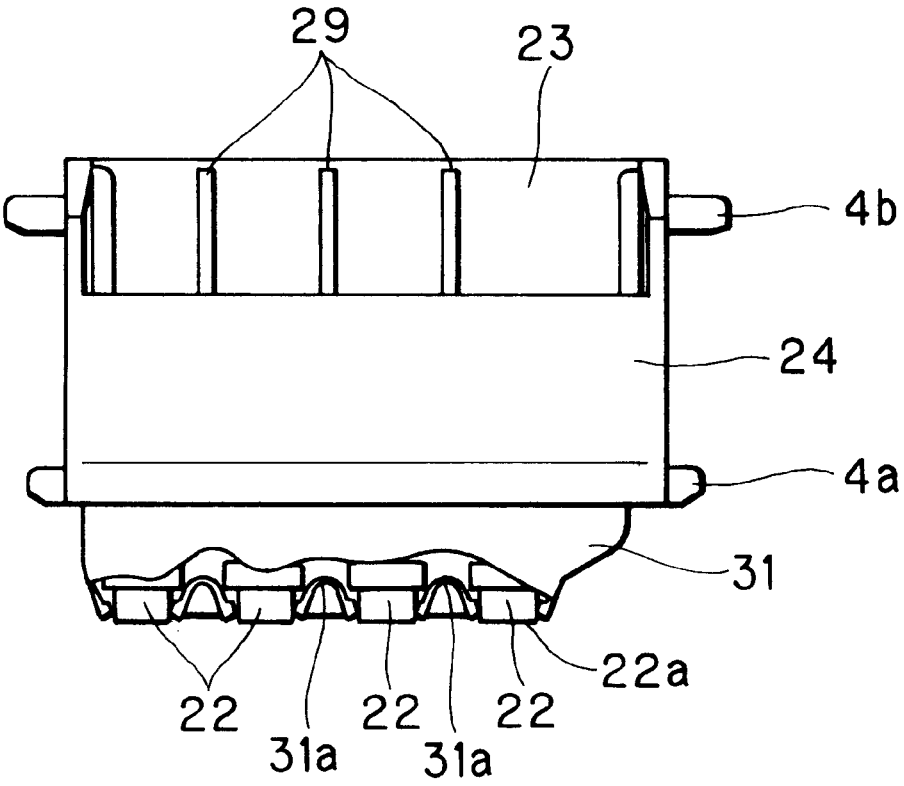
FIG. 6 is an enlarged view of FIG. 5 showing essential portions in the vicinity of the print chips of the print head.
Figure 7:
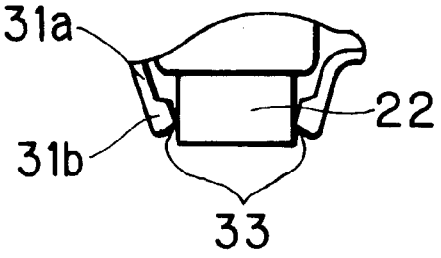
FIG. 7 is a plan view in partial cross section showing the head unit with portion of a cap removed to facilitate understanding.
Figure 8:
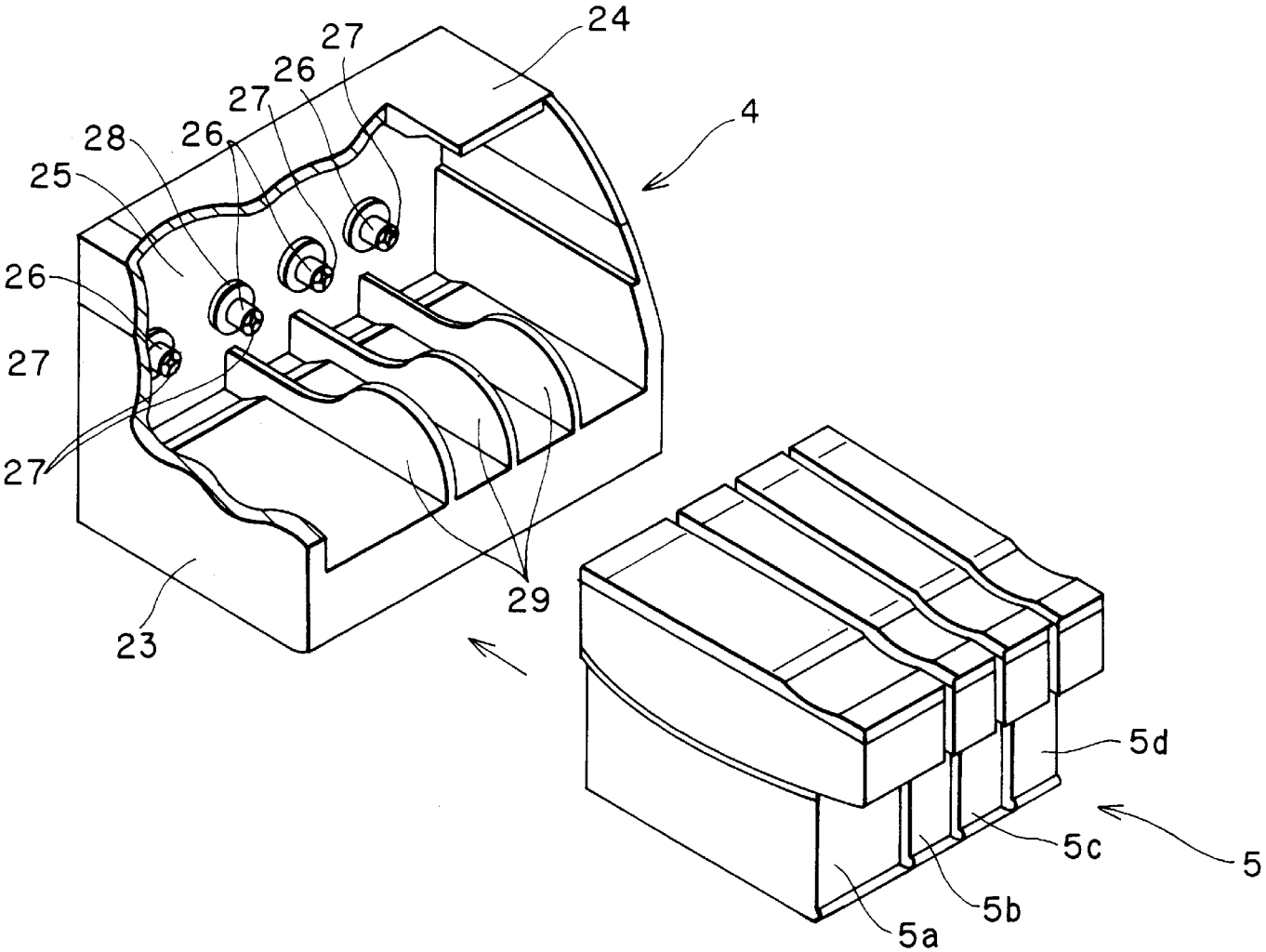
FIG. 8 is an enlarged view showing positioners supporting proper alignment of one of the print chips.

FIG. 2 is a perspective view of the head unit 4 including the print head 2. FIG. 3 is a plan view showing the print head 2. FIG. 4 is a cross-sectional view taken along line V—V of FIG. 3. FIG. 5 is an enlarged view showing essential portions of the print head 2. FIG. 6 is a plan view in partial cross section showing the head unit 4 with portion of a cap 24 removed to facilitate understanding. FIG. 7 is an enlarged view showing essential portions of the print head 2. FIG. 8 is a exploded perspective view from the rear of the head unit 4 with a portion removed to facilitate understanding of the configuration.

The print head 2 includes a plurality of head chips 22 all having the same shape and aligned in a horizontal direction, that is, in a direction parallel with the carriage shaft 7 and the platen roller 6. As shown in FIG. 3, each of the head chips 22 includes a nozzle surface 22*a* formed with a plurality of nozzles 21 for ejecting a corresponding one of the four colors of ink.

As shown in FIG. 2, the head unit 4 includes a holder 23, a cap 24, and a cover body 31, which together serve as the frame body of the head unit 4. Protrusions 4*a* and 4*b* are provided to aid positioning the head unit 4 when mounting the head unit 4 onto the carriage 3.

The cover body 31 is formed from a resin or other appropriate material. As shown in FIG. 6, the cover body 31 includes resilient head chip supports 31*a* formed substantially U-shaped in cross section. The head chip supports 31*a* are disposed in alternation with the head chips 22 for separating and positioning adjacent head chips 22. The plurality of the head chips 22 forming the main body of the print head 2 are fitted between the head chip supports 31*a* and aligned thereby in a horizontal direction along the front surface of the holder 23 in the cover body 31 so as to protrude away from the holder 23.

As shown in FIGS. 6 and 7, each head chip support 31*a* includes at horizontal sides thereof two positioners 31*b* each resiliently abutting against an adjacent head chip 22 to align the head chips 22 in the horizontal direction. As shown in FIG. 5, upper and lower exposure opening edges 31*c*, 31*d* of the cover body 31 abut the upper and lower surface of the head chips 22 to align the head chips 22 in the vertical direction. In this way, the cover body 31 includes, for each head chip 22, an exposure opening bordered by and defined by a front edge of the cover body 31, the front edge comprising the positioners 31*b* and the upper and lower exposure opening edges 31*c*, 31*d*. Said differently, the front edge is formed with an inner peripheral surface that matches an outer peripheral contour of the head chips 22 when the head chips 22 are in proper alignment. Therefore, by forming the cover body 31 with a precision sufficient to correctly align the four head chips 22, the cover body 31, in conjunction with supports 23*c* of the holder 23, will properly position and align the plurality of head chips 22 when the head chips are fitted in the exposure openings.

Each head chip 22 is fitted in its corresponding exposure opening so that its nozzle surface 22*a* only is exposed. The holder 23 and the rear edge of the cover body 31 are maintained in a sealed condition at connection portions 32. The head chips 22 and the front edge of the cover body 31 are maintained in a sealed condition at connection portions 33. Therefore, the cover body 31 encases the head chips 22 and covers the print head 2 except for the nozzles surfaces 22*a* formed with the nozzles 21. The sealed conditions at the connection portions 32, 33 are maintained using sealing techniques such as adhering with a sealing agent such as a silicone rubber that hardens at room temperature. An alternative sealing technique for maintaining the tight seal at the connection portions 32, 33 would be to weld the rear edge of the cover body 31 to the holder 23 and the front edge of the cover body 31 to the head chips 22. In this case, connection portions 32, 33 would represent welded areas.

Each of the plurality of head chips 22 includes a contact portion 35 where terminals in the substrates of the head chips 22 are soldered to a signal cable for transmitting an electric signal from a control unit to the plurality of head chips 22. In this example, the contact portions 35 are provided internally to the cover body 31, but could alternately be provided internally to the holder 23. In both cases, the contact portions 35 are provided within a sealed area formed by the connection portions 32, 33.

As shown in FIG. 4, an indentation 23*a* and a ribbon-shaped abutment protrusion 23*b* are formed in the holder 23 where the peripheral edge of the cover body 31 contacts the holder 23. The indentation 23*a* insures accuracy of positioning between the holder 23 and the cover body 31. The abutment protrusion 23*b* acts as a wedge against the cover body 31 to insure a tight fit between the holder 23 and the cover body 31.

As can best be seen in FIG. 8, ink introduction portions 26, through which ink from the ink cartridges 5*a* to 5*d* is supplied to the head chips 22, are disposed in apertures formed through a front wall 25 of the head unit 4. A filter 27 for removing dust and other foreign matter from supplied ink is attached to each ink introduction portion 26 at the end thereof opening toward the ink cartridges 5. Each head chip 22 includes a substrate having piezoelectric ceramic elements for generating energy required to eject ink. Ink channels are formed in the substrate and each is filled with one of the four colors of ink supplied from the ink cartridges 5 via the ink introduction portions 26. By controlling energization of elements, the substrate can be deformed to produce a change in volume in selective ones of the ink channels. Ink supplied from the ink cartridges 5*a* to 5*d* can therefore be selectively ejected from the nozzles 21.

Seal members 28 are mounted to the apertures formed in the front wall 25 and through which the ink introduction portions 26 pass. Ribs 29 are provided in the holder 23 to separate areas in which the four color ink cartridges 5*a* through 5*d* are set. When the ink cartridges 5*a* to 5*d* are set in their respective spaces, ink supply ports of the ink cartridges 5*a* to 5*d* come into fluid connection with respective ink introduction portions 26 so that ink is supplied to the head chips 22.

Next, an explanation will be provided for operation of the head unit 4 provided with the print head 2 having the above-described configuration. Each color of ink from the ink cartridges 5*a* to 5*d* is supplied to the head chips 22 of the print head 2 through respective ink introduction portions 26. Piezoelectric ceramic elements of the head chips 22 are driven based on print information. The resultant pumping operation ejects ink from the nozzles 21 so that color printing is performed on a print sheet P supplied at a position in opposition of the print head 2.

Because the head chips 22 are covered by the cover body 31 and the gaps between the cover body 31, the holder 23, and the head chips 22 are sealed closed, ink droplets ejected from the nozzles 21 will not seep into the holder 23. As a result, contacts inside the holder 23 will not be shorted out by ink. Because the cover body 31 is an integral unit, the number of places that need to be sealed can be greatly reduced so that manufacture is much easier. The cover body 31 acts to precisely align the head chips 22 so that the proper alinement of the head chips 22 can be achieved. As a result, ink droplets can be more precisely ejected to more accurately impinge at a desired position on the print sheet so that high quality color printing can be achieved.

While the invention has been described in detail with reference to specific embodiments thereof, it would be apparent to those skilled in the art that various changes and modifications may be made therein without departing from the spirit of the invention, the scope of which is defined by the attached claims.

For example, although the present invention was described to apply to an ink jet head provided with piezoelectric ceramic elements, the present invention could be applied to the other types of ink jet heads, such as a bubble jet type which operates by using force generated by expansion of a vapor bubble. Also, the present invention could be applied to a monochrome print head having only a single head chip.

What is claimed is:

1. A print head comprising:

a holder having a front surface;

at least one head chip protruding from the front surface of the holder, the at least one head chip each having a nozzle surface formed with nozzles for ejecting ink;

a cover body covering the front surface of the holder and a protruding portion of the at least one head chip and having at least one exposure opening for exposing the nozzle surface;

a first seal between a rear edge of the cover body and the holder; and a second seal between a front edge of the cover body and the at least one head chip;

wherein the first seal between the rear edge of the cover body and the holder and the second seal between the front edge of the cover body and the at least one head chip is maintained by one of a sealing agent and a welded area, the first seal between the rear edge of the cover body and the holder and the second seal between the front edge of the cover body and the at least one head chip forms a sealed area within the holder and the cover body, and the at least one head chip includes a contact portion connected to a signal line for transmitting an electric signal to the at least one head chip, the contact portion being provided within the sealed area.

2. A print head as claimed in claim 1, wherein the at least one head chip is fitted in the at least one exposure opening of the cover body, the front edge of the cover body having an inner peripheral surface formed to properly position the at least one head chip when the at least one head chip is fitted in the at least one exposure opening.

3. A print head as claimed in claim 2, wherein:

the at least one chip head includes a first chip head and a second chip head; and the holder includes an ink cartridge mounting portion for mounting a first ink cartridge containing a first color ink and a second ink cartridge containing a second color ink and for bringing the first head chip into fluid communication with the first ink cartridge and for bringing the second head chip into fluid communication with the second ink cartridge.

4. A print head as claimed in claim 1, wherein the front surface of the holder is formed with an indentation, the rear edge of the cover body being inserted in the indentation.

5. A print head as claimed in claim 1, wherein the front surface of the holder is formed with a protrusion for abutting the rear edge of the cover body and acting as a wedge to tightly fit the cover body to the holder.

6. A print head as claimed in claim 1, wherein the at least one head chip includes a first head chip and a second head chip juxtaposed in a line on the front surface of the holder.

7. A print head as claimed in claim 6, wherein the first head chip ejects a first color ink and the second head chip ejects a second color ink, the first color ink being different from the second color ink.

8. A print head as claimed in claim 7, wherein the holder includes an ink cartridge mounting portion for mounting a first ink cartridge containing the first color ink and a second ink cartridge containing the second color ink and for bringing the first head chip and the second head chip into fluid connection with the first ink cartridge and the second ink cartridge respectively.

9. A print head as claimed in claim 8, wherein the ink cartridge mounting portion includes filters disposed at positions where the first head chip is brought into fluid communication with the first ink cartridge and where the second head chip is brought into fluid communication with the second ink cartridge.

10. A print head as claimed in claim 8, wherein the ink cartridge mounting portion includes ribs for separating and positioning the first ink cartridge and the second ink cartridge.

11. A print head as claimed in claim 1, wherein the cover body includes a positioning means for positioning the at least one head chip.

12. A print head as claimed in claim 11, wherein:

the at least one head chip is fitted in the at least one exposure opening of the cover body; and the positioning means of the cover body includes an inner peripheral surface defining the at least one exposure opening and formed to properly position the at least one head chip when the at least one head chip is fitted in the at least one exposure opening.

13. A print head as claimed in claim 12, wherein:

the at least one head chip includes a plurality of head chips aligned in a horizontal direction; and the positioning means includes resilient head chip supports disposed in alternation with the plurality of head chips and in abutment at horizontal sides thereof with adjacent head chips of the plurality of head chips so as to align the plurality of the head chips in the horizontal direction.

14. The print head of claim 1, wherein the first seal is provided between an entire rear edge of the cover body and the holder, and wherein the second seal is provided between an entire front edge of the cover body and at least one head chip.

15. The print head of claim 1, wherein the cover body includes a protruding portion that protrudes from the holder along the protruding portion of the at least one head chip and extends from a rear edge of the cover body to the front edge of the cover body.

16. A printer comprising:

a holder having a front surface;

a plurality of head chips juxtaposed in a line on and protruding from the front surface of the holder, each of the plurality of head chips having a nozzle surface formed with nozzles for ejecting ink;

a cover body covering the front surface of the holder and a protruding portion of the plurality of head chips, a front edge bordering exposure openings exposing the nozzle surface of corresponding ones of the plurality of head chips;

a first seal between a rear edge of the cover body and the holder;

a second seal between a front edge of the cover body and the plurality of head chips;

a carriage mounting the holder; and a carriage drive system for reciprocally and linearly moving the carriage;

wherein the first seal between the rear edge of the cover body and the holder and the second seal between the front edge of the cover body and the plurality of head chips is maintained by one of a sealing agent and a welded area, the first seal between the rear edge of the cover body and the holder and the second seal between the front edge of the cover body and the plurality of head chips forms a sealed area within the holder and the cover body, and the plurality of head chips include contact portions connected to signal lines for transmitting electric signals to the plurality of head chips, the contact portions being provided within the sealed area.

17. A printer as claimed in claim 16, wherein:

the plurality of head chips are fitted in corresponding ones of corresponding openings; and the front edge of the cover body having an inner periphery surface formed to position the plurality of head chips.

18. A printer as claimed in claim 17, wherein:

the plurality of chip heads includes a first chip head and a second chip head; and the holder includes an ink cartridge mounting portion for mounting at least a first ink cartridge containing a first color ink and a second ink cartridge containing a second color ink and for bringing the first head chip into fluid communication with the first ink cartridge and for bringing the second head chip into fluid communication with the second ink cartridge.

19. A print head comprising:

a holder having a front surface;

at least one head chip protruding from the front surface of the holder, the at least one head chip each having a nozzle surface formed with nozzles for ejecting ink;

a cover body covering the front surface of the holder and a protruding portion of the at least one head chip and having at least one exposure opening for exposing the nozzle surface;

a first means for sealing a rear edge of the cover body to the holder; and a second means for sealing a front edge of the cover body to the at least one head chip;

wherein the first sealing means between the rear edge of the cover body and the holder and the second sealing means between the front edge of the cover body and the at least one head chip is maintained by one of a sealing agent and a welded area, the first sealing means between the rear edge of the cover body and the holder and the second sealing means between the front edge of the cover body and the at least one head chip forms a sealed area within the holder and the cover body, and the at least one head chip includes a contact portion connected to a signal line for transmitting an electric signal to the at least one head chip, the contact portion being provided within the sealed area.

20. A printer comprising:

a holder having a front surface;

a plurality of head chips juxtaposed in a line on and protruding from the front surface of the holder, each of the plurality of head chips having a nozzle surface formed with nozzles for ejecting ink;

a cover body covering the front surface of the holder and a protruding portion of the plurality of head chips, a front edge bordering exposure openings exposing the nozzle surface of corresponding ones of the plurality of head chips;

a first means for sealing a rear edge of the cover body to the holder;

a second means for sealing a front edge of the cover body to the plurality of head chips;

a carriage mounting the holder; and a carriage drive system for reciprocally and linearly moving the carriage;

wherein the first sealing means between the rear edge of the cover body and the holder and the second sealing means between the front edge of the cover body and the plurality of head chips is maintained by one of a sealing agent and a welded area, the first sealing means between the rear edge of the cover body and the holder and the second sealing means between the front edge of the cover body and the plurality of head chips forms a sealed area within the holder and the cover body, and the plurality of head chips include contact portions connected to signal lines for transmitting electric signals to the plurality of head chips, the contact portions being provided within the sealed area.

* * * * *